US006609664B1

(12) United States Patent
Tamhane

(10) Patent No.: US 6,609,664 B1
(45) Date of Patent: Aug. 26, 2003

(54) HEATING PANEL SYSTEM

(76) Inventor: Ashok Y. Tamhane, 94 Joanne Dr., Holbrook, NY (US) 11741

( * ) Notice: Subject to any disclaimer, the term of this patent is extended or adjusted under 35 U.S.C. 154(b) by 0 days.

(21) Appl. No.: 10/228,702

(22) Filed: Aug. 27, 2002

(51) Int. Cl.[7] ..... F24H 3/00
(52) U.S. Cl. ..... 237/70; 392/353; 165/183
(58) Field of Search ..... 237/70, 71, 73; 392/352, 353, 349, 351, 347; 165/182, 183

(56) References Cited

U.S. PATENT DOCUMENTS 1,775,257 A * 9/1930 Shurtleff ..... 165/182
3,294,158 A * 12/1966 Baljet et al. ..... 165/55
3,867,981 A * 2/1975 Monroe ..... 165/55
4,034,802 A * 7/1977 Schwarz ..... 165/55
4,607,791 A * 8/1986 Gantner ..... 237/71
5,825,973 A * 10/1998 Lehoe et al. ..... 392/353
6,072,938 A * 6/2000 Peterson et al. ..... 392/343

* cited by examiner

*Primary Examiner*—Derek Boles

(57) ABSTRACT

A heating panel system comprises a cylindrical hot water pipe. The pipe is in a linear configuration. A plurality of rigid fins is provided. The fins have apertures. The apertures allow the fins to be positioned over the pipe. In this manner inlet openings are formed. The inlet openings are of an enlarged size beneath the pipe and outlet openings. The pipe and outlet openings are of a reduced size above the pipes. In this manner the flow of heated air between the fins and across the pipe is increased due to venturi configuration of the design.

10 Claims, 3 Drawing Sheets

FIG 1
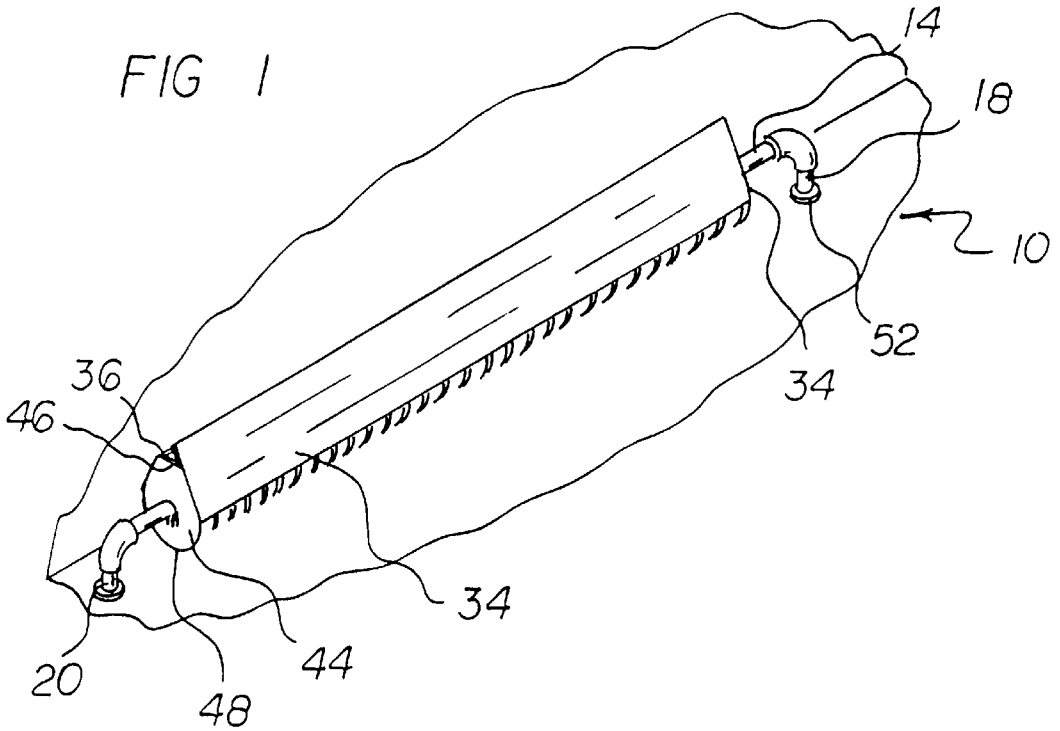
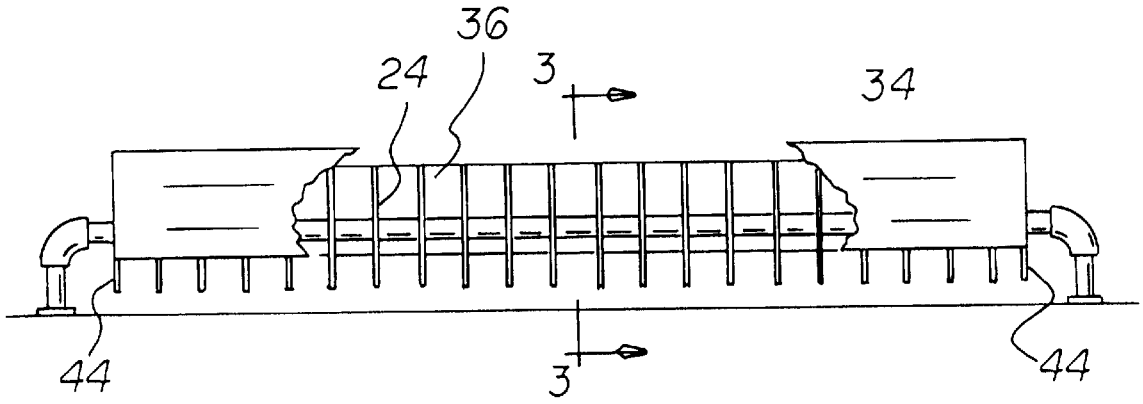
FIG 2

FIG 3
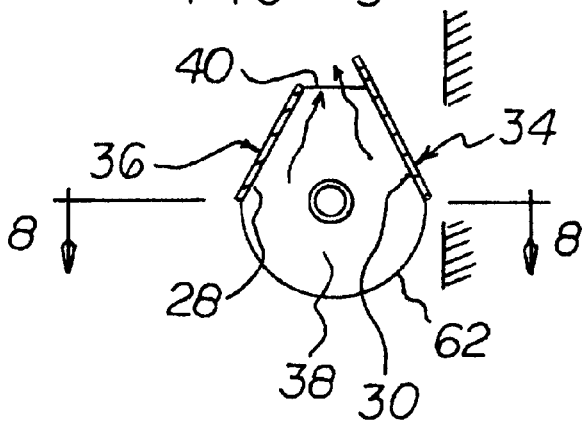
FIG 4
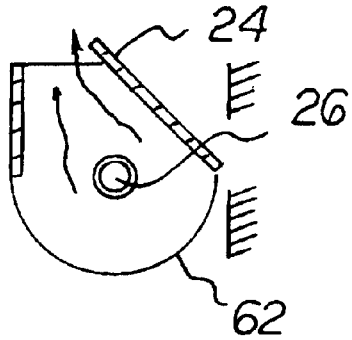
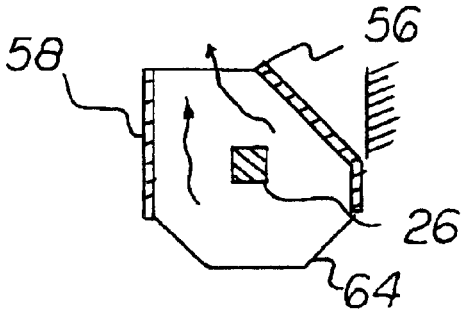
FIG 5
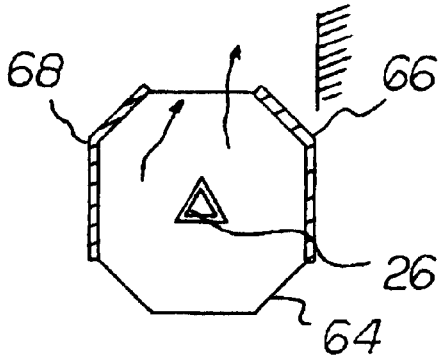
FIG 6
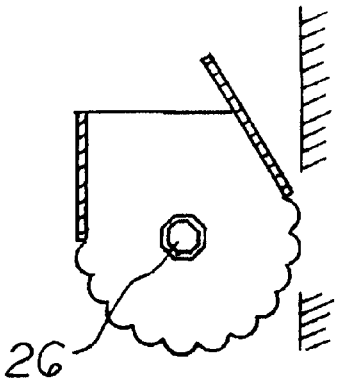
FIG 7
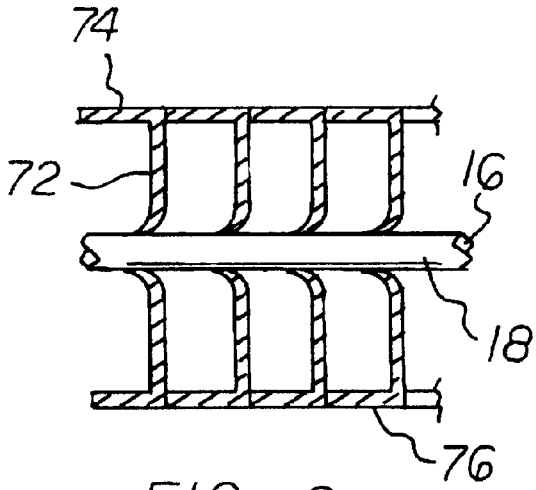
FIG 8

FIG 9
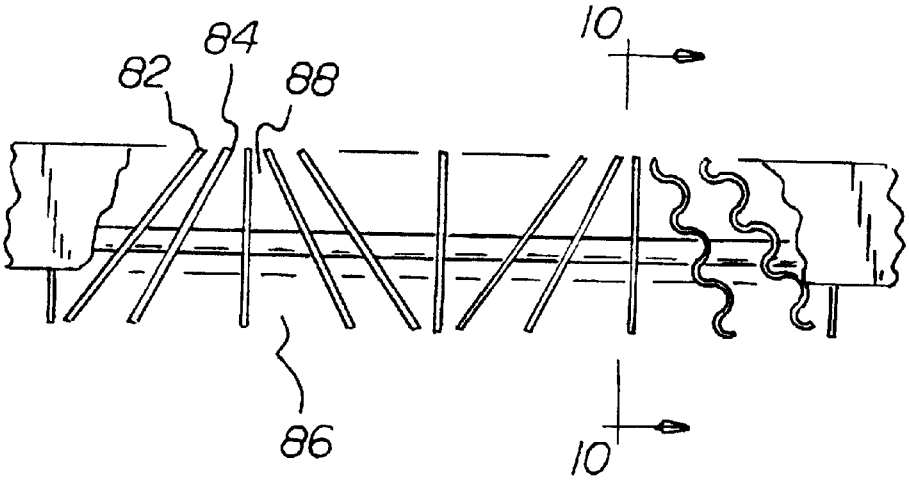
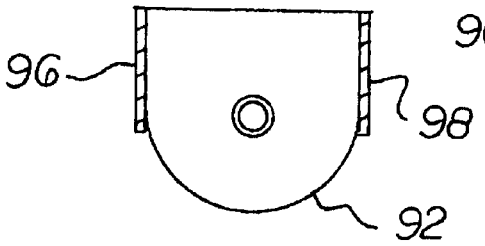
FIG 10
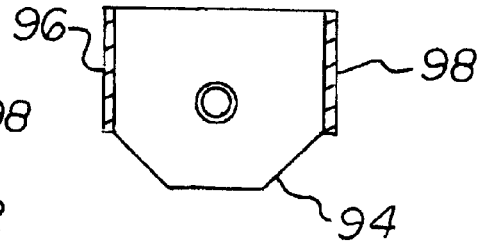
FIG 11
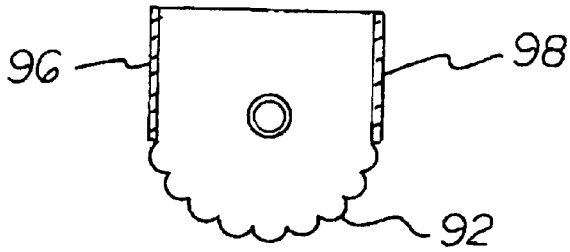
FIG 12

HEATING PANEL SYSTEM

BACKGROUND OF THE INVENTION

1. Field of the Invention

The present invention relates to a heating panel system and more particularly pertains to allowing a user to provide heat to a room in a safe and efficient manner.

2. Description of the Prior Art

The use of heating devices of conventional designs and configurations is known in the prior art. More specifically, heating devices of conventional designs and configurations previously devised and utilized for the purpose of providing heat through known methods and apparatuses are known to consist basically of familiar, expected, and obvious structural configurations, not withstanding the myriad of designs encompassed by the crowded prior art which has been developed for the fulfillment of countless objectives and requirements.

By way of example, U.S. Pat. No. 4,428,418 to Beasley et al discloses a Heat Exchanger Fin Element with Folded over Side Edges. U.S. Pat. No. 4,195,687 to Taziker discloses Space Heating Panels. U.S. Pat. No. 4,036,288 to Neveux discloses a Radiator Especially for the Air-Conditioning System of an Automobile. U.S. Pat. No. 4,614,230 to Sakuma et al discloses a Heat Exchanger. U.S. Pat. No. 5,706,886 to Kim discloses a Finner Tube Heat Exchanger. Lastly, U.S. Pat. No. 5,101,890 to Aoki et al discloses a Heat Exchanger.

While these devices fulfill their respective, particular objectives and requirements, the aforementioned patents do not describe a heating panel system that allows allowing a user to provide heat to a room in a safe and efficient manner.

In this respect, the heating panel system according to the present invention substantially departs from the conventional concepts and designs of the prior art, and in doing so provides an apparatus primarily developed for the purpose of allowing a user to provide heat to a room in a safe and efficient manner.

Therefore, it can be appreciated that there exists a continuing need for a new and improved heating panel system which can be used for allowing a user to provide heat to a room in a safe and efficient manner. In this regard, the present invention substantially fulfills this need.

SUMMARY OF THE INVENTION

In view of the foregoing disadvantages inherent in the known types of heating devices of conventional designs and configurations now present in the prior art, the present invention provides an improved heating panel system. As such, the general purpose of the present invention, which will be described subsequently in greater detail, is to provide a new and improved heating panel system and method which has all the advantages of the prior art and none of the disadvantages.

To attain this, the present invention essentially comprises of a heating element comprised of a hot water conducting pipe or steam conducting pipe or electrically heated hot rod is in a linear or "U" shaped configuration. The hot water or steam pipe is further fabricated of a rigid heat conductive metallic material. The hot water or steam pipe has an internal surface. The pipe can have a circular cross section or triangular or square or multi-sided cross section. The hot water or steam pipe also has an external surface. The pipe further has an input end and an output end. The input and output ends allow for the passage of hot water or steam through the internal area of the pipe. The heating element consisting of electrically heated rod is a metallic rod having a resistance. When alternating current (AC) or direct current (DC) electromotive force (voltage) is applied at both ends AC or DC (as per the characteristic of the voltage AC or DC) current passes through the rod producing heat. Provided next is a plurality of similarly configured rigid fins. The fins are fabricated of a heat conductive metallic material. The fins are in a generally truncated teardrop configuration. Each fin has an aperture of the shape and size of the heating element. The aperture is located at the approximate midpoint of the fin or below the midpoint. Each fin aperture has an internal area. The internal area is sufficient to allow each fin to be snugly slipped over the external surface of the heating element. Each fin further has a flat interior edge. The interior edge is adapted to support an interior cover plate. Each fin has a flat exterior edge. The exterior edge is adapted to support an exterior cover plate. A pair of cover plates is provided. The pair of cover plates includes an interior front cover plate and an exterior rear cover plate. The cover plates are fabricated of a rigid heat conductive metallic material, usually sheet metal. Each cover plate has a generally rectilinear configuration. The rear cover plate is coupled to the exterior edges of the fins. The exterior edges of the fins are oriented toward a room interior away from an adjacent wall. The front cover plate is coupled to the interior edges of the fins. The interior edges of the fins are oriented toward the adjacent wall of a room. The interior edges and exterior edges are at an angle with respect to each other and thus exterior and interior cover plates are at an angle with respect to each other. In this manner inlet openings are formed. The inlet openings are of an enlarged size beneath the heating element and outlet openings. The outlet openings are of a reduced size above the heating element. In this manner the flow of heated air across the heating element is increased, due to venturi configuration. Further provided is a pair of end plates. The end plates are fabricated of a rigid heat conductive metallic material, usually sheet metal. The end plates have an internal surface and an external surface. A peripheral edge is disposed between the internal and external surfaces. The peripheral edge has a top portion and a lower portion. The top portion of the end plates has a flattened edge. The lower portion of the end plate has a curved edge. In this manner a generally truncated teardrop configuration is formed. The truncated teardrop configuration corresponds to the shape of the fins. Both end plates are approximately the same size and shape. Last provided is a heating liquid or steam source. The heating liquid or steam source has an inflow and an outflow. The heating liquid or steam source is configured to be easily connected to the pipe thereby providing a source of heated fluid for the system. Heat can be provided by passing electric current through electrically resistant rod.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved heating panel system which has all of the advantages of the prior art heating devices of conventional designs and configurations and none of the disadvantages.

It is another object of the present invention to provide a new and improved heating panel system which may be easily and efficiently manufactured and marketed.

It is further an object of the present invention to provide a new and improved heating panel system which is of durable and reliable constructions.

An even further object of the present invention is to provide a new and improved heating panel system which is susceptible of a low cost of manufacture with regard to both materials and labor, and which accordingly is then susceptible of low prices of sale to the consuming public, thereby making such heating panel system economically available to the buying public.

Even still another object of the present invention is to provide a heating panel system for allowing a user to provide heat to a room in a safe and efficient manner.

Lastly, it is an object of the present invention to provide a new and improved heating panel system comprising a linear or "U" shaped hot water or steam pipe, or electric hot rod. A plurality of rigid fins is provided. The fins have apertures. The apertures allow the fins to be positioned over the pipe or rod. Front and rear cover plates or rectangular shape are fixed over the side (vertical) edges of the fins so that the cover plates are at right angles to the fins. In this manner air chambers are formed having lower inlet openings and upper outlet openings. The inlet openings are of an enlarged size beneath the pipe or heating element and outlet openings. The pipe and heating element outlet openings of reduced size are above the inlet openings. In this manner the flow of heated air between the fins and across the heating element is increased with higher velocity due to venturi configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the heating panel system constructed in accordance with the principles of the present invention.

FIG. 2 is a front elevational view of the system illustrated in FIG. 1 with parts broken away to show internal constructions.

FIG. 3 is a cross-sectional view taken along line 3—3 of FIG. 2.

FIGS. 4 through 7 are views similar to FIG. 3 but illustrating alternate embodiments of the invention.

FIG. 8 is a cross-sectional view taken along line 8—8 of FIG. 3, with the fins constructed in accordance with another alternate embodiment of the invention.

FIG. 9 is a view similar to FIGS. 2 and 8 but illustrating another alternate embodiment of the invention.

FIG. 10 is a cross-sectional view taken along line 9—9 of FIG. 9.

FIG. 11 is a cross-sectional view similar to FIG. 10 but illustrating another alternate embodiment of the invention.

FIG. 12 is a cross-sectional view similar to FIG. 9 but illustrating another alternate embodiment of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved heating panel system embodying the principles and concepts of the present invention and generally designated by the reference numeral 10 will be described.

The present invention, the heating panel system 10 is comprised of a plurality of components. Such components in their broadest context include a cylindrical, square or any multi-sided hot water or steam pipe or electric hot rod and a plurality of rigid fins. Such components are individually configured and correlated with respect to each other so as to attain the desired objective.

First provided is a hot water or steam pipe or electric hot rod 14. The pipe is in a linear configuration. The hot water pipe is further fabricated of a rigid heat conductive metallic material. The hot water or steam pipe has an internal surface 16. The hot water or steam pipe or electric hot rod also has an external surface 18. The pipe further has an input end 18 and an output end 20. The input and output ends allow for the passage of hot water or steam or hot air.

Provided next is a plurality of similarly configured rigid fins 24. The fins are fabricated of a heat conductive metallic material. The fins are generally truncated teardrop configuration. Each fin has an aperture 26 of the shape of the cross section of the heating element. The aperture is located at the approximate midpoint of the fin or below the midpoint. The aperture size is sufficient to allow each fin to be snugly slipped over the external surface of the heating element. Each fin further has a flat interior edge 28. The interior edge is adapted to support an interior cover plate. An interior cover plate 36 is attached to a row or fins. Each fin has an exterior edge 30. The exterior edge is adapted to support an exterior cover plate. An exterior cover plate 34 is attached to a row of fins.

A pair of cover plates is attached to a row of fins at the edges. The pair of cover plates includes an exterior cover plate 34 and a interior cover plate 36. The cover plates are fabricated of a rigid heat conductive metallic material. Each cover plate has a generally rectilinear configuration. The exterior cover plate is attached to the exterior edges of the fins. The exterior cover plate is oriented toward a room and away from an adjacent wall. The interior cover plate is attached to the interior edges of the fins. The interior cover plate is oriented toward the adjacent wall of a room. The interior edges and exterior edges are at an angle with respect to each other, thus interior and exterior cover plates are at an angle with respect to each other. In this manner inlet openings 38 are formed. The inlet openings are of an enlarged size beneath the pipe or heating element and outlet openings 40. The element and outlet openings are of a reduced size above the pipe or heating element. In this manner the flow of heated air across the pipe or heating element is increased due to venturi configuration of the design.

Further provided is a pair of end plates 44. The end plates are fabricated of a rigid heat conductive metallic material. The end plates have an internal surface and an external surface. A peripheral edge is disposed between the internal and external surfaces. The peripheral edge has a top portion and a lower portion. The top portion of the cover plates has a flattened edge 46. The lower portion of the end cover plate has a curved edge 48. In this manner a generally truncated teardrop configuration is formed. The truncated teardrop configuration corresponds to the shape of the fins. Both end plates are approximately the same size and shape. Basically, the end plates are same as the fins (shape, size and material. (Material could be thicker sheet metal than the fins)).

Last provided is a heating media such as water, steam, hot liquid or hot air source 52. The heating source has an inflow and an outflow. The heating media is configured to be easily connected to the pipe thereby providing a source of heating media for the system. In an alternate embodiment of the present invention, the system further includes a front cover plate and a rear cover plate. The front cover plate 58 extends to an elevation the same as the rear cover plate 56.

In another alternate embodiment of the present invention the fins have curved edges 62 at their lower regions.

In another alternate embodiment of the present invention the fins have linear edges 64 at their lower regions.

In still another alternate embodiment of the present invention the system further includes a front cover plate and a rear cover plate. The cover plates have bends 66, 68 adjacent to their upper ends.

As shown in FIG. 8, a showing taken along line 8—8 of FIG. 3 and similar sections of FIGS. 4, 5 and 6, the outside surface 18 of the heating element is shown. The fins are 72 and the cover plates are 74 and 76.

In still another alternate embodiment of the present invention the fins 82, 84 are offset with respect to each other. In this manner large lower inlet regions 86 and small upper outlet regions 88 are formed to increase the flow of heated air due to venturi configuration of this design.

In another alternate embodiment of the present invention, the fins have curved edges 92 at their lower regions.

In still another alternate embodiment of the present invention the fins have linear edges 94 at their lower regions.

In the last alternate embodiment of the present invention, shown in FIGS. 10, 11 and 12, fins 92 and 94 and two cover plates 96 and 98 are shown. This is the embodiment of FIG. 9.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heating panel system for allowing a user to provide heat to a room in a safe and efficient manner comprising, in combination:

a heating element comprising a cylindrical hot water or steam pipe or electrically resistive-metal rod in a linear configuration or a "U" shaped configuration and fabricated of a rigid heat conductive metallic material with an external surface with circular, triangular, square or cross section of any shape, the pipe having an input end and an output end for allowing the passage of hot water or steam through the internal cross section of the pipe, or passage of electric current through the electrically resistive metal rod;

a plurality of similarly configured rigid fins fabricated of a heat conductive metallic material in a generally truncated teardrop configuration with each fin having an aperture located at the approximate midpoint or below midpoint of the fin, each fin aperture having an internal surface sufficient to allow each fin to be snugly slipped over the hot water or steam pipe or electrically resistive rod, each fin having flat interior edges adapted to support an interior cover plate and flat exterior edges adapted to support an exterior cover plate;

a pair of cover plates with an interior cover plate and an exterior cover plate being fabricated of a rigid heat conductive metallic material, each cover plate having a generally rectilinear configuration, with the exterior cover plate being coupled to the exterior edges of the fins and thereby oriented toward a room interior away from an adjacent wall and the interior cover plate being coupled to the interior edges of the fins and thereby oriented toward the adjacent wall of a room, the interior surface and exterior surface being at an angle with respect to each other to form inlet openings of an enlarged size beneath the pipe and outlet openings of a reduced size above the pipes to thereby increase the flow of heated air across the pipe due to the venturi configuration of the design; and a heating liquid source having an inflow and an outflow and being configured to be easily connected to the pipe, thereby providing a source of heated fluid for the system, or the electrical connections are configured to be easily accessible thereby providing a source of electric power for the electric heating rod to produce heat for the system.

2. A heating panel system comprising:

a cylindrical hot water or steam pipe or electrically resistive metal rod in a linear configuration; and a plurality of rigid fins with apertures to allow the fin to be positioned over the pipe to form inlet openings of an enlarged size beneath the pipe and outlet openings of a reduced size above the pipe or the electrical rod to thereby increase the flow of heated air between the fins and across the pipe due to the venturi configuration.

3. The system as set forth in claim 2 and further including a front cover plate and a rear cover plate and wherein the front cover plate extends to an elevation higher than the rear cover plate.

4. The system as set forth in claim 2 and further including a front cover plate and a rear cover plate and wherein the front cover plate extends to an elevation the same as the rear cover plate.

5. The system as set forth in claim 2 wherein the fins have curved edges at their lower regions.

6. The system as set forth in claim 2 wherein the fins have linear edges at their lower regions.

7. The system as set forth in claim 2 and further including a front cover plate and a rear cover plate and wherein the cover plates have bends adjacent to their upper ends.

8. The system as set forth in claim 2 and wherein the fins are offset with respect to each other to form large lower inlet regions and small upper outlet regions for the increased flow of heated air due to venturi configuration.

9. The system as set forth in claim 8 wherein the fins have curved edges at their lower regions.

10. The system as set forth in claim 8 wherein the fins have linear edges at their lower regions.

* * * * *